US006082913A

United States Patent [19]

Yamamoto et al.

[11] Patent Number: 6,082,913

[45] Date of Patent: Jul. 4, 2000

[54] CARTRIDGE FOR PRINTING

[75] Inventors: Toshiyuki Yamamoto; Hidenori Kiuchi, both of Iwate-ken, Japan

[73] Assignee: Alps Electric Co., Ltd., Tokyo, Japan

[21] Appl. No.: 09/111,056

[22] Filed: Jul. 7, 1998

[30] Foreign Application Priority Data

Jul. 15, 1997 [JP] Japan ..... 9-189596

[51] Int. Cl.[7] ..... B41J 35/28

[52] U.S. Cl. ..... 400/208; 400/624; 400/246; 400/120.01

[58] Field of Search ..... 101/288; 400/208, 400/624, 613, 208.1, 120.01, 194, 195, 611, 196, 246; 347/214; 271/145, 147

[56] References Cited

U.S. PATENT DOCUMENTS

| | | | |
|---|---|---|---|
| 5,005,998 | 4/1991 | Takanashi et al. | 400/208 |
| 5,216,441 | 6/1993 | Isobe | 400/208 |
| 5,277,502 | 1/1994 | Kim | 400/196 |
| 5,771,803 | 6/1998 | Takami | 400/208 |
| 5,909,973 | 6/1999 | Siwinski | 400/208 |

FOREIGN PATENT DOCUMENTS

| | | |
|---|---|---|
| 0203665 | 12/1986 | European Pat. Off. . |
| 63-128963 | 6/1988 | Japan . |
| 63-242669 | 10/1988 | Japan . |
| 07009745 | 1/1995 | Japan . |
| 08300750 | 11/1996 | Japan . |

*Primary Examiner*—Christopher A. Bennett
*Attorney, Agent, or Firm*—Brinks, Hofer, Gilson & Lione

[57] ABSTRACT

In conventional cartridges, the image receiving tape is formed as a roll of long tape, which is taken up by a tape supply roll and accommodated in a case, so that the image receiving tape after printing becomes curly; when or after separating the separation tape of the image receiving tape, it tends to, for example, become inclined when glued to a predetermined place, thus making it difficult to handle.

In view of this, in the cartridge K of the present invention, the recording member 16 is formed as a strip and accommodated in a second case 12 in a flat state, whereby the recording member after recording does not become curly, thereby making it easier to handle.

4 Claims, 4 Drawing Sheets

CARTRIDGE FOR PRINTING

BACKGROUND OF THE INVENTION

1. Field of the Invention

The present invention relates to a cartridge for printing and, in particular, to a cartridge for use in a thermal printing apparatus that records by using a thermal head.

2. Description of the Related Art

A recording apparatus for preparing labels has been widely known which uses a cartridge accommodating in a case an image receiving tape consisting of a roll of elongated label sheet or the like and an ink ribbon and which records by transferring ink of the ink ribbon to the image receiving tape.

The conventional cartridge and recording apparatus will be described with reference to FIGS. 7 and 8.

First, as shown in FIG. 7, which is an essential-part sectional view, the conventional cartridge R comprises a case 1 whose outer configuration is substantially rectangular. Side walls la formed around the case 1 cover the interior of the case 1.

In the upper right section of the cartridge, there is formed a substantially U-shaped head insertion recess 1*b*. In the upper left section of the head insertion recess 1*b*, there is formed a tape feed opening 1*c*, and, in the upper right section of the head insertion recess 1*b*, there is formed a tape discharge opening 1*d*.

Formed in the right side wall 1*a* is a ribbon registration section 1e equipped with two openings. Further, a substantially semi-circular tape re-wind window 1*f* is formed on the lower side of the top of the portion of the case 1 on the left-hand side of the head recess 1*b*.

Arranged on the left-hand side of the head insertion recess 1*b* is a tape supply spool 3 around which an elongated image receiving tape 2 consisting of paper or the like is wound in the form of a roll. Integrally formed in the lower section of the tape supply spool 3 is a gear plate 3*a* having a plurality of teeth in its outer periphery.

The image receiving tape 2 is drawn out of the tape feed opening 1*c* into the head insertion recess 1*b*. Then, the image receiving tape 2, which has undergone image recording in the head insertion recess 1*b*, passes through the tape discharge opening 1*d* to be discharged to the exterior of the cartridge R.

Arranged below the head insertion recess 1*b* are a ribbon supply spool 5 around which an ink ribbon coated with ink of a desired color is wound and a take-up spool 6 for taking up the ink ribbon 5 unreeled from the ribbon supply spool 5.

The ink ribbon 4 is drawn out of the tape feed opening 1*c* and fed to the head insertion recess 1*d*, ink being transferred to the image receiving tape 2 by a thermal head 7 described below to effect image recording.

After recording, the used ink ribbon 4 enters the interior of the case 1 again through the tape discharge opening 1*d* and is temporarily brought to the exterior at the ribbon registration section 1*e* before it is taken up by the ribbon take up spool 6.

When the ink ribbon 4 is a color ink ribbon, the ribbon registration section 1*e* makes it possible for the color in which the printing is to be started to be checked from outside and to determine the position at which printing in desired color is to be started.

In a recording apparatus (not shown) for recording images on the image receiving tape 2 by using the above-described conventional cartridge R, there is formed a cassette attachment section (not shown) or the like to which the cartridge R is attached.

As shown in FIG. 8, in this cassette attachment section, there are arranged a rotatable thermal head 7 having a heat generating section 7*a*, a platen roller 8, and a rewind gear 9. When the cartridge R is attached to the cassette attachment section, the thermal head 7 is positioned in the head insertion recess 1*b* of the cartridge R, and the rotatable platen roller 8 is arranged above and outside the head insertion recess 1*b* and at a position opposed to the thermal head 7.

Positioned in the tape rewind window 1*f* of the case 1 is a tape rewind gear 9 having a plurality of teeth in its outer periphery, the tape rewind gear 9 being engaged with the gear of the gear plate 3*a* of the tape supply spool 3.

When recording a color image using a color ribbon as the ink ribbon 4, the tape rewind gear 9 which is engaged with the gear of the gear plate 3*a* of the tape supply spool 3 is rotated. The image receiving tape 2 on which recording has been effected by transferring the ink of the first color is rewound, and ink of an ink ribbon of another color is superimposed for recording, whereby a color image of a desired color is obtained.

The cartridge R is placed on the cassette attachment section of the conventional recording apparatus, constructed as described above, and, as shown in FIG. 8, the image receiving tape 2 and the ink ribbon 4 are superimposed one upon the other and, in this condition, are guided between the thermal head 7 and the platen roller 8.

Then, the thermal head 7 is rotated, and the image receiving tape 2 and the ink ribbon 4 are pressed against the platen roller 8 at the heat generating section 7*a*; the heat generating section 7*a* of the thermal head 7 is controlled, and, while feeding the image receiving tape 2 and the ink ribbon 4 toward the tape discharge opening 1*d* by rotating the platen roller 8, ink of the ink ribbon 7 is transferred to the image receiving tape 2 to thereby record a desired image on the image receiving tape 2.

This recording apparatus is especially suitable for printing on a narrow and long label or the like and is widely used.

However, in the above-described conventional cartridge R, the image receiving tape 2 is formed as a roll of elongated tape, taken up by the tape supply spool 3 and accommodated in the case 1, so that the image receiving tape 2 after printing is curly; when or after separating the separation tape of the image receiving tape 2, it tends to be inclined when attached to a predetermined place, which makes the cartridge difficult to handle.

Further, since the image receiving tape 2 is formed as a roll of elongated tape, it has to be cut in a requisite length for use after desired characters, etc. have been recorded on the image receiving tape 2. Thus, it is necessary to incorporate a tape cutting mechanism in the recording apparatus, with the result that the recording apparatus is rather expensive.

Further, when no tape cutting mechanism is incorporated in the recording apparatus, the image receiving tape 2 after recording has to be cut by scissors, a cutter or the like.

SUMMARY OF THE INVENTION

The present invention has been made with a view toward solving the above problems in the conventional recording apparatus. It is an object of the present invention to provide a cartridge for a recording apparatus in which the recording member (image receiving tape) does not become curly and in which there is no need to cut the recording member with scissors or the like after recording, whereby the handling of the recording member after recording is facilitated.

Another object of the present invention is to provide a cartridge for a recording apparatus comprising an ink ribbon, supply and take-up reels around which the respective end portions of the ink ribbon are wound, a recording member in the form of a strip onto which ink of the ink ribbon is transferred for recording, and a case accommodating the ink ribbon, the supply and take-up reels, and the recording member, whereby the recording medium does not become curly, and there is no need to cut it after recording, thus facilitating the handling of the recording medium.

Still another object of the present invention is to provide a cartridge wherein there is formed in the case of the cartridge a paper feed roller insertion section into which a paper feed roller for supplying the recording member to the exterior of the case is inserted, whereby the paper feed roller of the recording apparatus is inserted into the interior of the cartridge from the paper feed roller insertion section, making it possible for the recording member in the incase to be reliably supplied to the exterior of the cartridge.

A further object of the present invention is to provide a cartridge wherein there is formed in the case of the cartridge a holding section for rotatably holding the forward end portion of the paper feed roller of the recording apparatus, whereby, when the cartridge is attached to the cartridge mounting section of the recording apparatus, the forward end portion of the paper feed roller is supported by the holding section, and the paper feed roller is supported on both sides, so that the paper feed roller rotates without rattling, making it possible for the recording member in the cartridge to be fed in a stable manner.

A still further object of the present invention is to provide a cartridge wherein inks of a plurality of colors are longitudinally applied to the ink ribbon, and the application area of the ink of each color is at least equivalent to the recording area of the recording member, whereby a high quality color image can be recorded on the entire recording area of the recording member.

A still further object of the present invention is to provide an ink cartridge wherein the area of the take-up reel accommodating section is larger than the area of the supply reel accommodating section, whereby the entire ink ribbon can be reliably taken up to the end even when creases, distortion, etc. are generated in the ink ribbon after recording due to the heat generation, etc. of the heat generating section of the recording head to cause the outer diameter of the pancake-like ink ribbon taken up by the take-up reel to become large.

DESCRIPTION OF THE PREFERRED EMBODIMENTS

Embodiments of the present invention will now be described with reference to the drawings.

Figure 1:
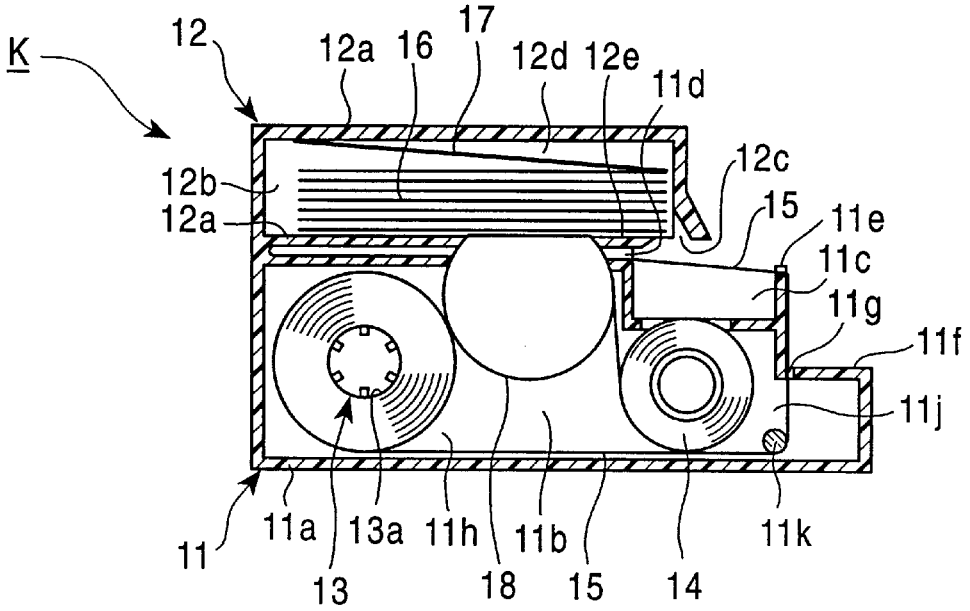
FIG. 1 is a sectional view showing the structure of the essential part of a cartridge for printing according to the present invention.

First, as shown in FIG. 1, which is an essential-part sectional view, a cartridge K of the present invention is composed of a first case 11 and a second case 12, which are formed by molding or the like using a resin material and which are formed into an integral unit, the outward appearance of the whole being rectangular with one corner thereof having a step-like configuration.

The first case 11 is arranged on the lower side as seen in the drawing. Formed in the outer periphery of the first case 11 is a side wall 11*a* enclosing the interior of the case, the side wall protruding from a bottom plate 11*b* to a predetermined height. An upper cover (not shown) is placed on the side wall 11*a* to define the hollow interior.

A substantially U-shaped cutout 11*c* is formed in the upper right end section as seen in the drawing of the first case 11, and a ribbon feed opening 11*d* is formed in the upper left portion of the cutout 11*c*.

In the upper right portion as seen in the drawing of the cutout 11*c*, there is formed a ribbon discharge section 11*e* formed by an end surface of the side wall 11*a*. In that portion of the side wall 11*a* which is on the right-hand side of the first case 11, there is formed a substantially L-shaped step portion 11*f*, in the base portion of which there is formed a ribbon take-up opening 11*g*.

In the interior of the first case 11, a take-up reel accommodating section 11*h* is formed on the left-hand side as seen in the drawing, and a supply reel accommodating section 11*j* is formed in the above-mentioned cutout portion 11*c* on the right-hand side. The area of the take-up reel accommodating section 11*h* is larger than the area of the supply reel accommodating section 11*j*.

Further, in that portion of the interior of the first case 11 which is below the ribbon take-up opening 11*g*, a ribbon guide 11*k* is rotatably supported by the bottom plate 11*b* and the upper cover (not shown).

A take-up reel 13 and a supply reel 14 are rotatably supported by the bottom plate 11*b* of the first case 11 and the upper cover, in the take-up reel accommodating section 11*h* and the supply reel accommodating section 11*j*, respectively.

Further, a bobbin hole 13*a* is formed at the center of rotation of the take-up reel 13.

An ink ribbon 15 whose end portions are respectively wound around the take-up reel 13 and the supply reel 14 is accommodated in the interior of the first case 11.

Figure 4:
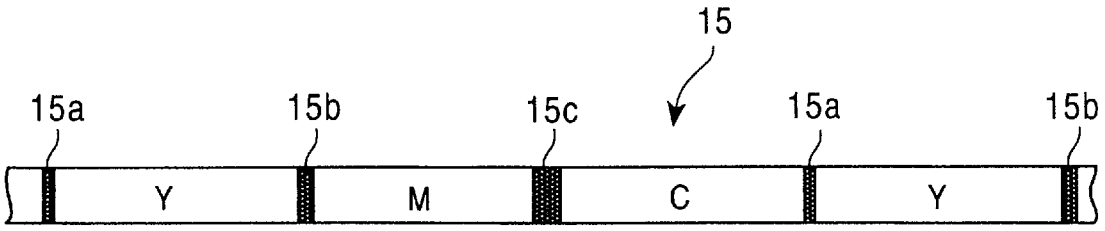
FIG. 4 is a plan view showing the construction of an ink ribbon to be accommodated in the cartridge shown in FIG. 1.

Inks of a plurality of colors are applied to the ink ribbon 15 sequentially in the longitudinal direction. For example, as shown in FIG. 4, yellow (Y), magenta (M) and cyan (C) inks are repeatedly applied.

The inks of a plurality of colors are applied in a width equivalent to the recording width of the recording member 16 and in a length at least equivalent to that of the printing region of the recording member 16. That is, the application area of the inks of a plurality of colors is equivalent to or larger than the recording area of the recording member 16.

At the forward ends of the inks of a plurality of colors, detection markers 15*a*, 15*b* and 15*c* having different widths are formed so that the colors can be discriminated from each other. Further, at the rear end of the ink ribbon 15, there is formed an end marker (not shown).

The feeding route for the ink ribbon 15 is as follows. When the ribbon is drawn out from the ribbon feed opening 11*d* of the cutout portion 11*c* to the cutout portion 11*c* in the exterior, and recording is performed by the recording apparatus of the present invention described below, the ink ribbon 15 after recording is guided by the ribbon discharge section 11*e* of the cutout portion 11*c* and led down to the step portion 11*f* along the outer surface of the side wall 11*a* in the upper right section forming the ribbon discharge section 11*e*.

Then, the ribbon is drawn into the supply reel accommodating section 11*j* again from the ribbon take-up opening 11*g* formed in this step portion 11*f*, and guided by the rotatable ribbon guide 11*k*; it is guided along the inner surface of the side wall 11*a* on the lower side of the first case 11*a* and led to the left as seen in the drawing to be taken up by the take-up reel 13.

On the upper side of the first case 11, the second case 12 is formed integrally therewith. Formed in the outer periphery of the second case 12 is a side wall 12*a* enclosing the interior and protruding from a bottom plate 12*b* to a predetermined height. An upper cover (not shown) is placed on the side wall 12*a* to define a closed interior.

The lower section of the right-hand side portion of the side wall 12*a* of the second case 12 is formed so as to be curved toward the exterior, and in the corner in the lower right section of the second case 12, there is formed an image receiving paper discharge opening 12*c* capable of discharging the recording member 16 described below.

In the hollow interior of the second case 12, a plurality of recording members 16 in the form of laterally elongated strips are arranged in a row such that they are perpendicular to the bottom plate 12*b* and parallel to the side wall 12*a* which separates the first case 11 from the second case 12.

Figure 6A:
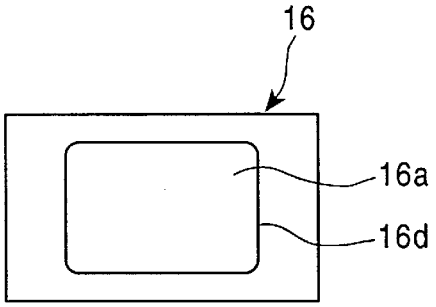
FIGS. 6A and 6B are plan views showing the construction of a recording member to be accommodated in the ribbon cartridge of the present invention.
Figure 6B:
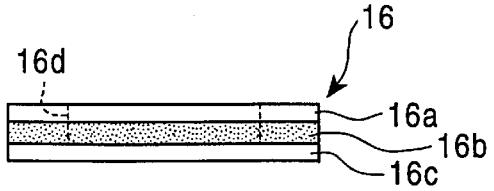
Figure 7:
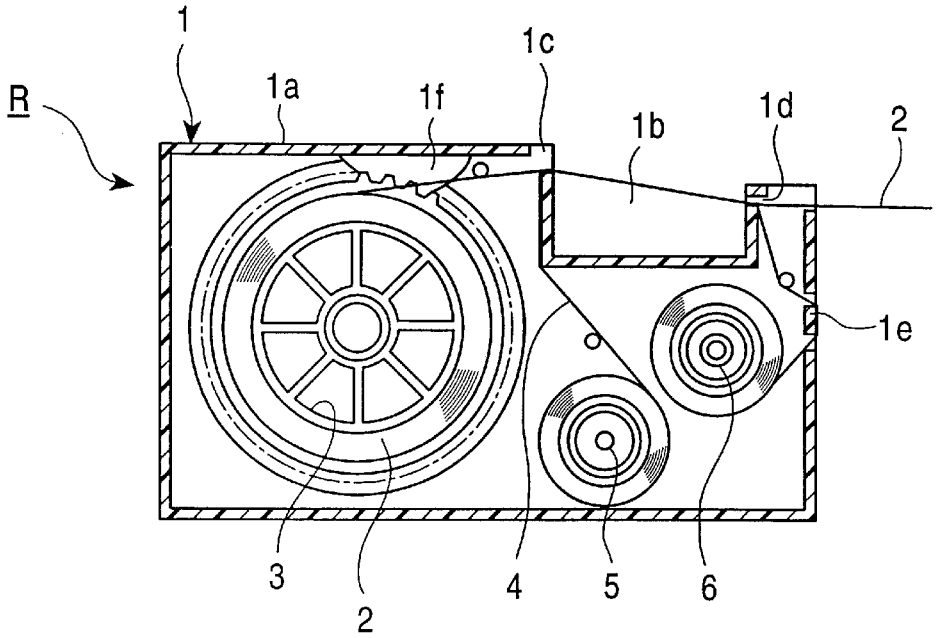
FIG. 7 PRIOR ART
FIG. 7 is an essential-part sectional view schematically showing the construction of a conventional ink cartridge.
Figure 8:
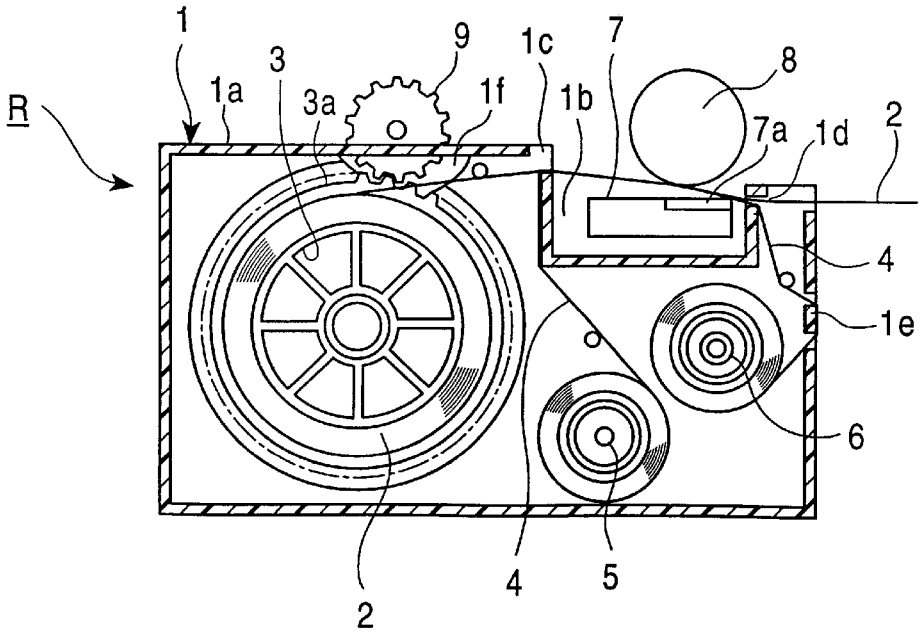
FIG. 8 PRIOR ART
FIG. 8 is a schematic diagram showing the construction of a recording apparatus on which the ink cartridge shown in FIG. 7 is mounted.

As shown, for example, in FIGS. 6A and 6B, the recording member 16 includes an image receiving paper 16*a* consisting of paper or the like arranged on the surface thereof; the recording member is in the form of a strip with an adhesive layer 16*b* being formed on the back side of the image receiving paper 16*a* and glued to a separation sheet 16*c*.

For example, a substantially rectangular cutting line 16*d* is formed on the inner side of the outer periphery of the image receiving paper 16*a* of the recording member 16, and the image receiving paper 16*a* can be separated along the cutting line 16*d* in a seal-like manner.

The depth of the cutting line 16*d* is such that it at least reaches the adhesive layer 16*b*. When the image receiving paper 16*a* is separated from the separation sheet 16*c*, the adhesive is also separated from the separation sheet 16*c* and remains on the back side of the image receiving paper 16*a*.

Further, the configuration of the cutting line 16*d* is not restricted to a rectangular one. An arbitrary design, for example, a heart-shaped one, can be selected.

Further, a gap 12*d* is provided between the plurality of recording members 16 and the upper side wall 12*a* of the second case 12. A spring member 17 consisting of a leaf spring or the like is arranged in the gap 12*d*, and constantly pressurizes the recording members 16 forwardly from behind with a predetermined pressure toward the first case 11.

Extending over the section of the bottom plate 11*b* which is on the left-hand side of the cutout portion 11*c* of the first case 11 and the bottom plate 12*b* of the second case 12 is a paper feed roller insertion section 18 in the form of an opening into which a paper feed roller 24 described below and adapted to supply the recording member 16 to the exterior is to be inserted.

Formed in the recording apparatus for printing and recording an image on the recording member 16 by using the cartridge K of the present invention, described above, are a key input section (not shown) which makes it possible to input a desired image and a cassette mounting section to which the cartridge K of the present invention is to be mounted.

Arranged in this cassette mounting section are a recording head 20 for recording a desired image on the recording member 16 consisting of a thermal head having a heat generating section 20*a* and a cylindrical platen roller 21.

Formed on the recording head 20 is a recording width which is equivalent to or more than the recording area in the width direction of the recording member 16.

When the cartridge K is mounted to the cassette mounting section, the cutout portion 11*c* of the first case 11 is positioned at the recording head 20, and the platen roller 21, which is rotatable, is arranged in the upper right section of the exterior of the cutout portion 11*c* and at a position where it is opposed to the heat generating section 20*a* of the recording head 20.

The heat generating section 20*a* of the recording head 20 can rotate so as to be capable of coming into contact with and moving away from the platen roller 21.

Further, at a position on the downstream side of the recording head 20 and on the right-hand side of the platen roller 21, there is arranged a feeding roller 22 which is capable rotating to the right and left.

A small roller 23 is arranged so as to be in contact with the lower side of the outer periphery of the feeding roller 22; the small roller 23 can rotate with the rotation of the feeding roller 22. The recording member 16 is resiliently held between the feeding roller 22 and the small roller 23, and the feeding roller 22 can be rotated so that the recording member 16 can be fed both upstream and downstream of the feeding roller 22.

Further, in the cassette mounting section, the paper feed roller 24 for supplying the recording member 16 accommodated in the cartridge K to the recording head 20 on the downstream side is arranged so as to be rotatable by a drive source (not shown) such as a motor.

A part of the cylindrical outer configuration of this paper feed roller 24 is cut so as to exhibit a flat cut surface 24*a* so that the roller has a D-shaped configuration;

this paper feed roller is coated with a substance having large frictional resistance, such as rubber.

When the cartridge K is placed on the cassette mounting section of the recording apparatus of the present invention, the paper feed roller 24 is inserted into the paper feed roller insertion section 18 of the cartridge K, and the cut surface 24*a* of the paper feed roller 24 is at a position where it is opposed to and spaced apart from the recording member 16.

Then, a predetermined gap is formed between the cut surface 24*a* and the recording member 16, and the paper feed roller 24 is set in the standby state before it is rotated.

Further, arranged below and to the left of the paper feed roller 24 is a take-up bobbin 25 which is perpendicular to the cassette mounting surface and rotatable, the take-up bobbin 25 being engaged with the bobbin hole 13*a* of the take-up reel 13.

When taking up the ink ribbon 15, the take-up reel 13 is rotated by a drive source (not shown) for rotating the take-up bobbin 25 clockwise, making it possible for the ink ribbon 15 wound around the supply reel 14 to be taken up.

Arranged to the right of the feeding roller 22 is a paper detection roller 27, which can detect the recording member 16 fed.

Further, arranged below the small roller 23 and in the vicinity of the step portion 11*f* of the first case 11 when the cartridge K is mounted to the cassette mounting section is a ribbon sensor 28, which can detect the detection markers 15*a*, 15*b* and 15*c* formed for the respective colors of the ink ribbon 15 and the ribbon end marker (not shown).

The above-mentioned sensors 27 and 28 consist of reflection type photo sensors.

Figure 2:
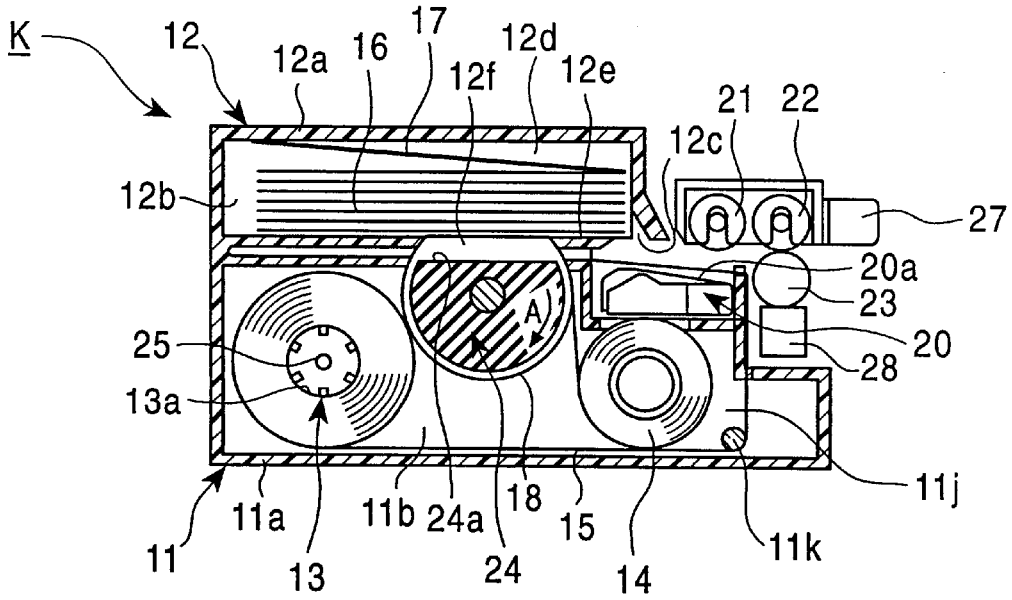
FIG. 2 is a schematic diagram showing the cartridge of FIG. 1 as mounted on a recording apparatus.
Figure 3:
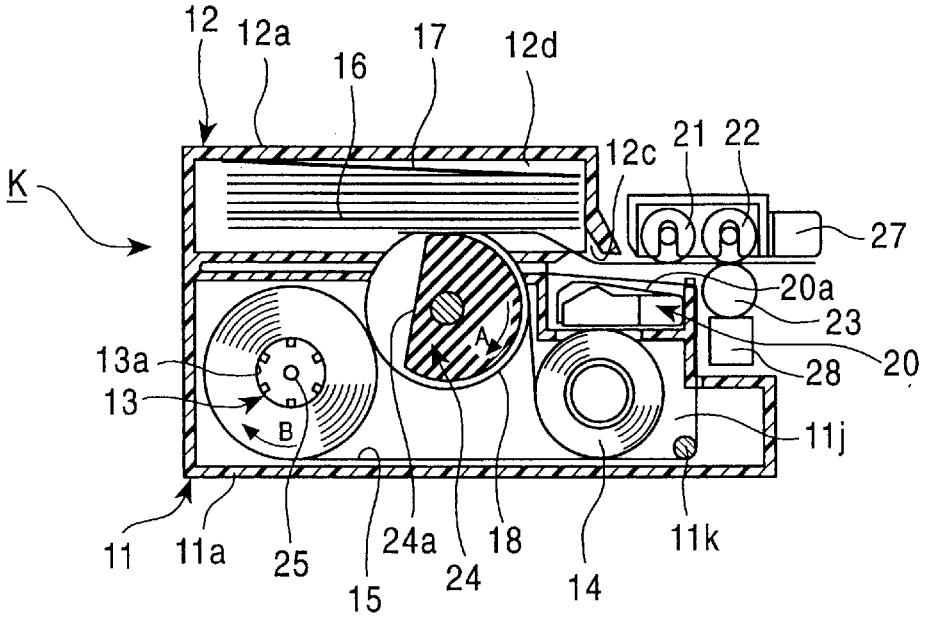
FIG. 3 is a schematic diagram for illustrating the operation of the recording apparatus shown in FIG. 2.

Next, the recording operation of the recording apparatus using the cartridge K of the present invention will be described. FIG. 2 is a schematic diagram illustrating the state in which the cartridge K is mounted to the cassette mounting section of the recording apparatus; the drawing shows the standby condition before recording is started.

When, in the state of FIG. 2, a recording start command is issued from the recording apparatus (not shown), the paper feed roller 24 is rotated clockwise in the direction of an arrow A by a drive source (not shown) such as a motor, and the left-hand end portion of the D-cut surface 24*a* pressurizes the recording members 16.

Then, the recording members 16 move so as to make the gap 12*d* at the back smaller against the resilient force of the spring member 17. When the paper feed roller 24 is further rotated clockwise, the foremost recording member 16 is separated from the other recording members 16 due to the friction between it and the outer surface of the cylindrical paper feed roller 24, and fed to the recording head 20 on the downstream side. Then, the forward end of the recording member 16 is resiliently held between the feeding roller 22 and the small roller 23, and, by the counterclockwise rotation of the feeding roller 22, the forward end of the recording member 16 is fed to the downstream side of the paper detection sensor 27.

Next, when the paper feed roller 24 has rotated 360°, the cylindrical outer periphery thereof is separated from the foremost recording member 16, and the condition is restored in which the cut surface 24*a* is opposed to the recording member 16 accommodated in the second case 12, with no pressurizing load of the paper feed roller 24 being applied to the recording member 16.

When the paper detection sensor 27 detects the recording member 16 and is turned ON, the recording member 16 is further fed through a predetermined distance. When the rear end of the recording member 16 is detached from the paper presser section 12*e* of the second case 12, the feeding roller 22 is reversed clockwise, and the recording member 16 is returned to the gap portion 12*f* below the second case 12 and on the upstream side until the paper detection sensor 27 is turned OFF.

When the paper detection sensor 27 is turned OFF, the reversing of the feeding roller 22 is stopped.

Next, the take-up bobbin 25 engaged with the take-up reel 13 is rotated clockwise as indicated by an arrow B. When the ribbon sensor 28 detects the detection mark of an ink of a desired color, for example, the detection mark 15*a* of yellow (When performing color printing, the printing is started with yellow), is detected, the rotation of the take-up reel 13 is stopped and the ribbon take-up operation is temporarily brought to a stop.

Next, the recording head 20 is rotated, and the heat generating section 20*a* thereof is moved to the platen roller 21 side, the recording member 16 and the ink ribbon being held under pressure between it and the platen roller 21. In this condition, the feeding roller 22 is rotated counterclockwise to feed the recording member 16 to the paper detection sensor 27 on the downstream side.

The ink ribbon 15 is also fed downstream with the recording member 16 and taken up by the take-up reel 13.

Then, a reference position is determined at the point in time when the paper detection sensor 27 detects the forward end of the recording member 16 and is turned ON. From this point in time onwards, heat generation control is effected on the heat generating section 20*a* of the recording head 20, and the printing is started for example, in yellow. At the same time, the feeding roller 22 is rotated, and while feeding the recording member 16 downstream at a predetermined speed, yellow ink is transferred to the recording member 16 to record a desired image.

The used ink ribbon 15 is taken up by the take-up reel 13 by rotating the take-up bobbin 25, whereby printing in yellow is completed.

Next, the recording head 20 is separated from the platen roller 21, and the feeding roller 22 is rotated in the reverse direction, i.e., clockwise, the recording member 16 being returned to the gap portion 12*f* below the second case 12 and on the upstream side until the paper sensor 17 is turned OFF.

When the paper sensor 17 is turned OFF, the take-up reel 13 is turned in the direction of the arrow B by ribbon take-up operation, and the ink ribbon 15 is taken up until the detection marker of the color next to yellow, for example, the detection marker 15*b* of magenta (M), is detected by the ribbon sensor 28. When the ribbon sensor 28 detects the detection marker 15*b* of magenta (M), the recording head 20 is brought into press contact with the platen roller 21.

Then, the feeding roller 22 is rotated counterclockwise to locate the forward end of the recording member 16, and magenta ink is transferred to the recording member 16 by the same printing operation as in the above yellow printing, thus performing repeated recording.

Further, cyan color (C) is transferred by the same recording operation as that for yellow and magenta.

When a color image of desired colors has been recorded on the recording member 16 by this recording operation, the feeding roller 22 is further rotated counterclockwise, and the recording member 16 after recording is discharged to the exterior of the recording apparatus, whereby the recording operation of the recording apparatus of the present invention is completed.

On the second recording member 16 also, the same operation as described above is repeated, whereby a desired color image can be recorded.

Assuming that the recording member 16 on which a desired image has been recorded by the above-described recording operation is one as shown in FIG. 6A, the seal-like image receiving paper 16*a* is separated along the cutting line 16*d*, whereby the image receiving paper 16*a* with the adhesive layer 16*b* attached to the back side is separated from the separation sheet 16*c*.

When this seal-like image receiving paper 16*a* separated from the separation paper 16*c* is glued to a desired place, the seal-like image receiving paper 16*a* can be brought into close contact with the adhesion surface and glued thereto due to the adhesiveness of the adhesive layer 16*b*.

Figure 5:
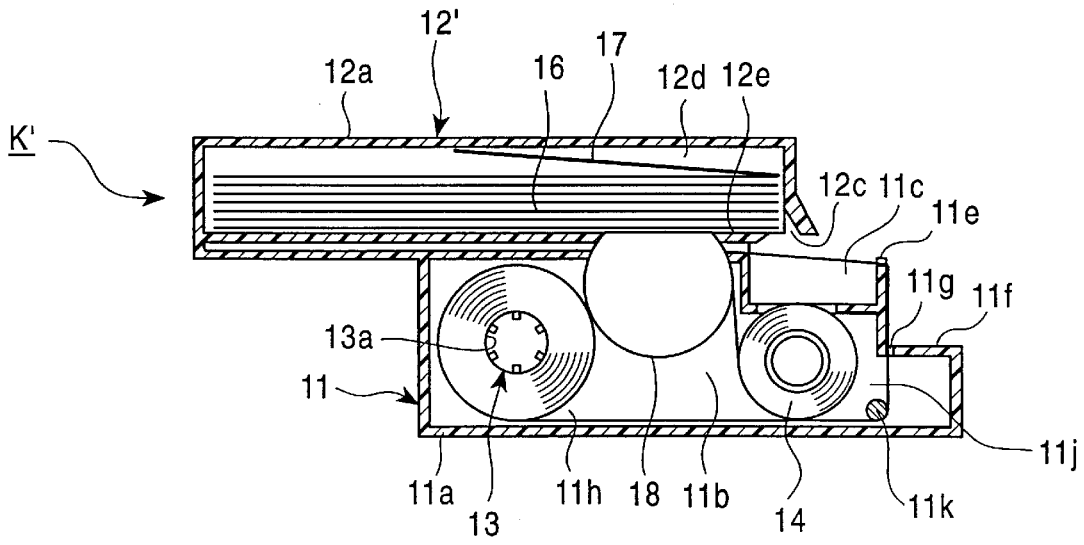
FIG. 5 is an essential-part sectional view for illustrating a ribbon cartridge according to another embodiment of the present invention.

In the case of a recording member 16' as shown in FIG. 5, which is still larger in the longitudinal direction, it is possible to perform panorama printing using the above-described recording apparatus of the present invention solely by adopting a larger second case 12' in conformity with the longer recording member 16'. In this case, the application area of the ink of each color on the ink ribbon 15 is equivalent to or more than the printing area of the elongated recording member 16'.

While in the above-described embodiment of the present invention the recording member 16 consists of paper, such as image receiving paper, the recording member 16 is not restricted to paper. It may also be a resin film such as plastic, or one without any adhesive material.

Further, in the above-described embodiment the ink ribbon used is one for color recording as shown in FIG. 4, this should not be construed restrictively. It is also possible to perform recording by using an ink ribbon 15 to which only a single color ink, such as black ink, is applied. In this case, when there is between images a predetermined portion where no recording is effected, the recording head 20 is raised for a period corresponding to this portion, and the feeding roller 22 is rotated to feed only the recording member 16 by an amount correspond to that portion. After this, the recording head 20 is lowered to record the remaining images, whereby a reduction in the running cost for the ink ribbon 15 can be achieved.

Further, while in the above-described embodiment three kinds of detection markers 15*a*, 15*b* and 15*c* are provided when an ink ribbon for color recording is used, it is also possible to use only the detection marks 15*a* for the first color, yellow, as a reference; regarding magenta and cyan, their distances from the detection markers 15*a* for yellow and their order are fixed, so that it is possible to determine recording positions for magenta and cyan according to the number of revolution (the feeding distance of the recording member 16). Further, it is also possible to determine recording positions by using a magenta marker subsequent to the reference marker 15*a* and a cyan marker subsequent thereto.

Further, when an ink ribbon 15 having no ribbon end marker is used, it is possible to determine that the ribbon has come to an end when no marker is detected after ribbon feeding has been effected for a predetermined period.

Further, it is also possible for the operation of taking up the ink ribbon 15 to be conducted with the head being lowered and in interlock with the paper feeding operation. In this case, the driving motor for the take-up reel 14 taking up the ink ribbon 15 and the driving motor for the paper feeding roller 24 may be the same driving motor.

As described above, the cartridge of the present invention comprises an ink ribbon, supply and take-up reels around which the end portions of the ink ribbon are respectively wound, a strip-like recording member to which ink of the ink ribbon is transferred to record an image, and a case for accommodating the ink ribbon and the strip-like recording member; since the recording member is formed as a strip, there is no need to cut the recording member after recording by means of scissors or the like, thus facilitating the handling of the recording member discharged from the recording apparatus after recording.

Further, in the cartridge of the present invention, a paper feed roller insertion section into which the paper feed roller for feeding the recording member to the exterior is inserted is formed in the case, so that the paper feed roller is inserted into the interior of the cartridge from this paper feed roller insertion section, whereby the internal recording member can be reliably supplied to the recording head outside the cartridge.

Further, in the cartridge of the present invention, a holding section for rotatably holding the forward end portion of the paper feed roller is formed in the case, so that, when the cartridge K is placed on the cassette mounting section, the forward end of the paper feed roller is supported by the holding section, and the paper feed roller is supported on both sides, whereby the paper feed roller rotates without rattling, making it possible for the recording member to be fed in a stable manner.

Further, in the cartridge of the present invention, inks of a plurality of colors are applied longitudinally to the ink ribbon, and the application area of these inks of a plurality of colors is equivalent to or more than the recording area of the recording member, so that it is possible to reliably record a high quality color image on the entire recording area of the recording member.

Further, in the cartridge of the present invention, the area of the take-up reel accommodating section is larger than the area of the supply reel accommodating section, so that even when creases or deformation is generated in the ink ribbon after recording due to the heat generation, etc. of the heat generating section of the recording head, and the outer diameter of the pancake-like ink ribbon taken up by the take-up reel becomes larger, it is possible to reliably take up the entire ink ribbon to the end since the area of the take-up reel accommodating section is larger.

What is claimed is:

1. A cartridge comprising:

a first case;

an accommodating portion formed within the first case to receive a supply reel and a take-up reel that are each coupled to an end of an ink ribbon, respectively;

a second case unitarily coupled to the first case and having a recess formed therein, the recess being dimensioned to receive a flat print medium and having a portion positioned above at least one of the supply reel and the take-up reel, respectively;

a cutout portion formed in the first case to receive a recording head; and a paper-feed roller portion positioned within the first and the second case, the paper-feed roller portion being dimensioned to receive a fixed axis roller that transfers the print medium to the recording head when the cartridge is engaged by a mounting section.

2. A cartridge according to claim 1 wherein said accommodating portion comprises a supply reel accommodating section and a take-up reel accommodating section, wherein the area of the take-up reel accommodating section is larger than the area of the supply reel accommodating section.

3. A cartridge according to claim 1 wherein the paper-feed roller portion is positioned so that the roller is in contact with the print medium when the cartridge is engaged by the mounting section.

4. A cartridge according to claim 1 further comprising a resilient member coupled to an interior wall of the second case and a portion of the print medium.

* * * * *